US012709957B1

(12) United States Patent
Hosie et al.

(10) Patent No.: US 12,709,957 B1
(45) Date of Patent: Aug. 18, 2026

(54) TUBING HANGER ORIENTATION SYSTEM

(71) Applicant: Hosie Subsea Ingenuity & Evolution LLC, Katy, TX (US)

(72) Inventors: Stanley Hosie, Katy, TX (US); Lee Hosie, Katy, TX (US)

(73) Assignee: Hosie Subsea Ingenuity & Evolution LLC, Richmond, TX (US)

( * ) Notice: Subject to any disclaimer, the term of this patent is extended or adjusted under 35 U.S.C. 154(b) by 0 days.

(21) Appl. No.: 18/387,447

(22) Filed: Nov. 6, 2023

(51) Int. Cl.
*E21B 33/035* (2006.01)
*E21B 33/04* (2006.01)

(52) U.S. Cl.
CPC ..... *E21B 33/0415* (2013.01); *E21B 33/035* (2013.01)

(58) Field of Classification Search
CPC ..... E21B 33/0415; E21B 33/035
See application file for complete search history.

(56) References Cited

U.S. PATENT DOCUMENTS

| | | | | |
|---|---|---|---|---|
| 8,151,892 | B2 | 4/2012 | Williams et al. | |
| 9,273,531 | B2 * | 3/2016 | Tan | E21B 33/047 |
| 9,376,872 | B2 | 6/2016 | June | |
| 10,808,483 | B2 * | 10/2020 | Hosie | E21B 33/035 |
| 11,286,739 | B2 | 3/2022 | June et al. | |
| 11,421,501 | B2 | 8/2022 | Murphy | |
| 11,834,918 | B2 * | 12/2023 | McLaughlin | E21B 33/043 |
| 2022/0290522 | A1 | 9/2022 | Ross et al. | |

* cited by examiner

*Primary Examiner* — Aaron L Lembo
(74) *Attorney, Agent, or Firm* — Adams IP

(57) ABSTRACT

A system for orienting a tubing hanger in a wellhead in subsea oil well equipment. The system comprises a tubing hanger having an extendable orientation pin that interfaces with a helical surface inside the high pressure housing of the wellhead, causing the tubing hanger to rotate to a desired rotational position upon the application of upward force to the tubing hanger. The tubing hanger may then be lowered (relanded) and secured, maintaining the desired rotational position.

20 Claims, 7 Drawing Sheets

TUBING HANGER ORIENTATION SYSTEM

FIELD OF THE INVENTION

This disclosure relates generally to subsea development wells. More specifically, it relates to the orientation of a subsea Christmas tree on a subsea development well. Even more specifically, it relates to a system for facilitating orientation of a subsea tubing hanger within a subsea development wellhead, orientating the subsea Christmas tree to the required heading for ease of connection to a manifold or pipeline.

BACKGROUND

Installation of offshore subsea deepwater development wells presents numerous difficulties. Compared to shallow water projects, deepwater projects limit the types of devices that can be used. Additionally, raising and lowering devices in deep water is very time consuming and thus very costly.

Historically and currently the method of installing a development well in deepwater involves installing a tubing head spool on top of the well after the production casing has been installed in the well. To do this, the blowout preventer (BOP) and drilling vessel must be disconnected and then reconnected to allow installation of the tubing head spool, a process that can take multiple days and thus cost millions of dollars.

Recently, there have been attempts to solve these problems. One such solution is to eliminate the need for the tubing head spool. In eliminating the tubing head spool, it is necessary to land the tubing hanger in the wellhead and orient the tubing hanger in the proper orientation.

Solutions for orienting the system are described in U.S. Pat. No. 11,421,501. One solution described is a system having a vertically oriented helical structure that is engaged by a fixed pin on the tubing hanger to rotate the tubing hanger as it is lowered in the wellhead. There are several issues with this design. The design requires additional equipment and a trip to the wellhead to install it. The helical structure intrudes into the diameter of the high pressure housing and due to the vertical orientation debris may collect in the helix, impeding the function. The design also lacks positive feedback that orientation has been achieve. Another solution described in the same patent uses a helical groove in the high pressure housing and a spring-loaded pin to engage with the groove. However, this design also lacks positive feedback of proper orientation and there is a risk that the spring-loaded pin slips past the helical groove and doesn't engage at all.

It would therefore be advantageous to have a device which avoids these and other drawbacks of existing methods and devices.

SUMMARY OF THE INVENTION

A tubing hanger orientation system as described herein may comprise a high pressure housing and a tubing hanger. The high pressure housing may comprise a central bore having an internal diameter and an orientation helix therein. The orientation helix comprising a lower annular surface having a helical shape. The tubing hanger may comprise an orientation pin capable of being extended radially outward such that when in an extended position the orientation pin interfaces with the orientation helix as the tubing hanger is raised, causing the tubing hanger to rotate.

The tubing hanger may further comprise an indexable sleeve containing the outwardly biased key and the orientation pin, wherein the indexable sleeve can be secured in a plurality of rotational positions relative to a tubing hanger body. The indexable sleeve may further comprise a radial hole for receiving a locking pin and the tubing hanger body comprises a plurality of radial holes for receiving the locking pin. The outwardly biased key may have a chamfered upper surface and a chamfered lower surface, allowing the tubing hanger to be inserted or removed from the high pressure housing.

The high pressure housing may further comprise a key slot comprising an oval slot extending radially outward through the orientation helix. The tubing hanger may further comprise an outwardly biased key sized to fit in the key slot for restricting rotational movement of the tubing hanger relative to the high pressure housing.

The lower annular surface of the orientation helix may have a symmetrical helical shape. The orientation helix may have a diameter equal or greater than the internal diameter of the central bore of the high pressure housing. The tubing hanger may further comprise a chamber containing the orientation pin and a passage connected to the chamber for applying fluid pressure to extend the orientation pin.

The high pressure housing may further comprise a capture feature at the upper most edge of the lower annular surface, the capture feature comprising a slot sized to accommodate the orientation pin, extending radially through the orientation helix beyond the internal diameter of the central bore, the slot extending downward through the lower annular surface.

DETAILED DESCRIPTION

Deepwater subsea development wells pose significant challenges in remotely installing the system equipment, such as orienting tubing hangers in a subsea wellhead. Current methods and devices may take days and cost millions of dollars to install. To that end, an improved system for orienting a tubing hanger is disclosed herein.

FIGS. 1-4 depict various views of the components of a tubing hanger orientation system according to embodiments.

Figure 5:
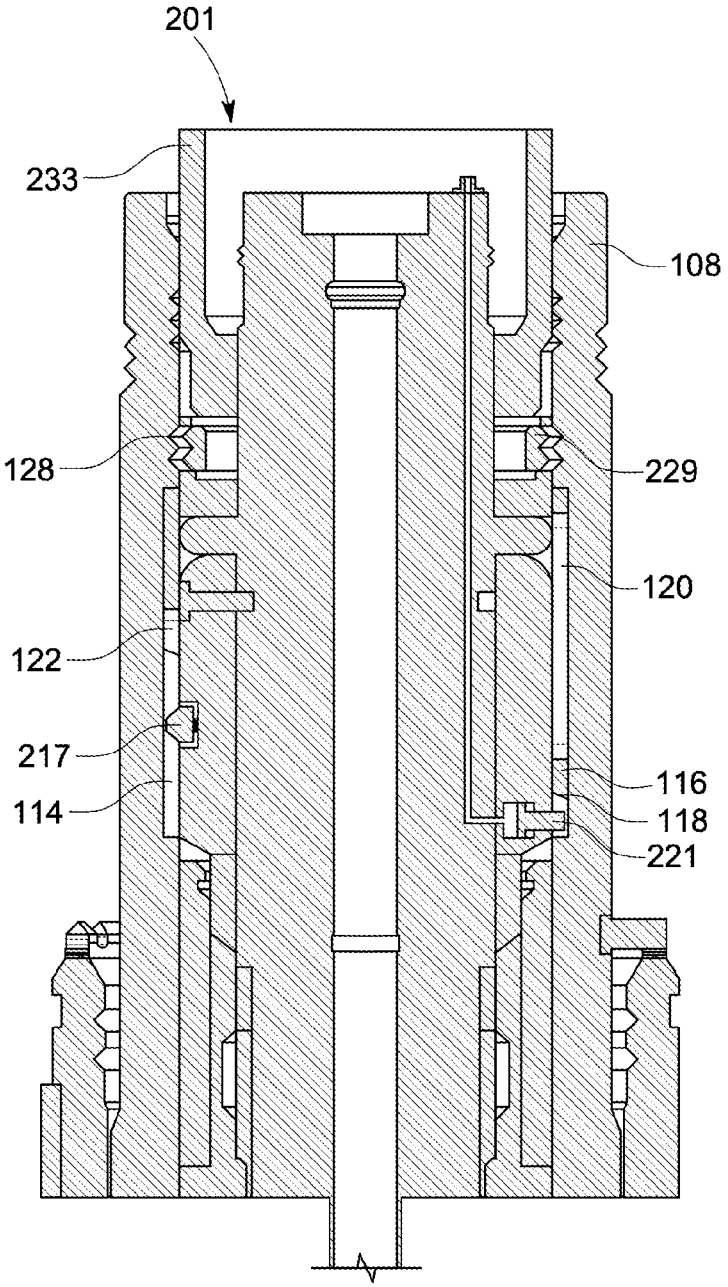
FIG. 5 depicts a section view of a tubing hanger orientation system according to one embodiment where the tubing hanger has been landed and the orientation pin is extended.
Figure 6:
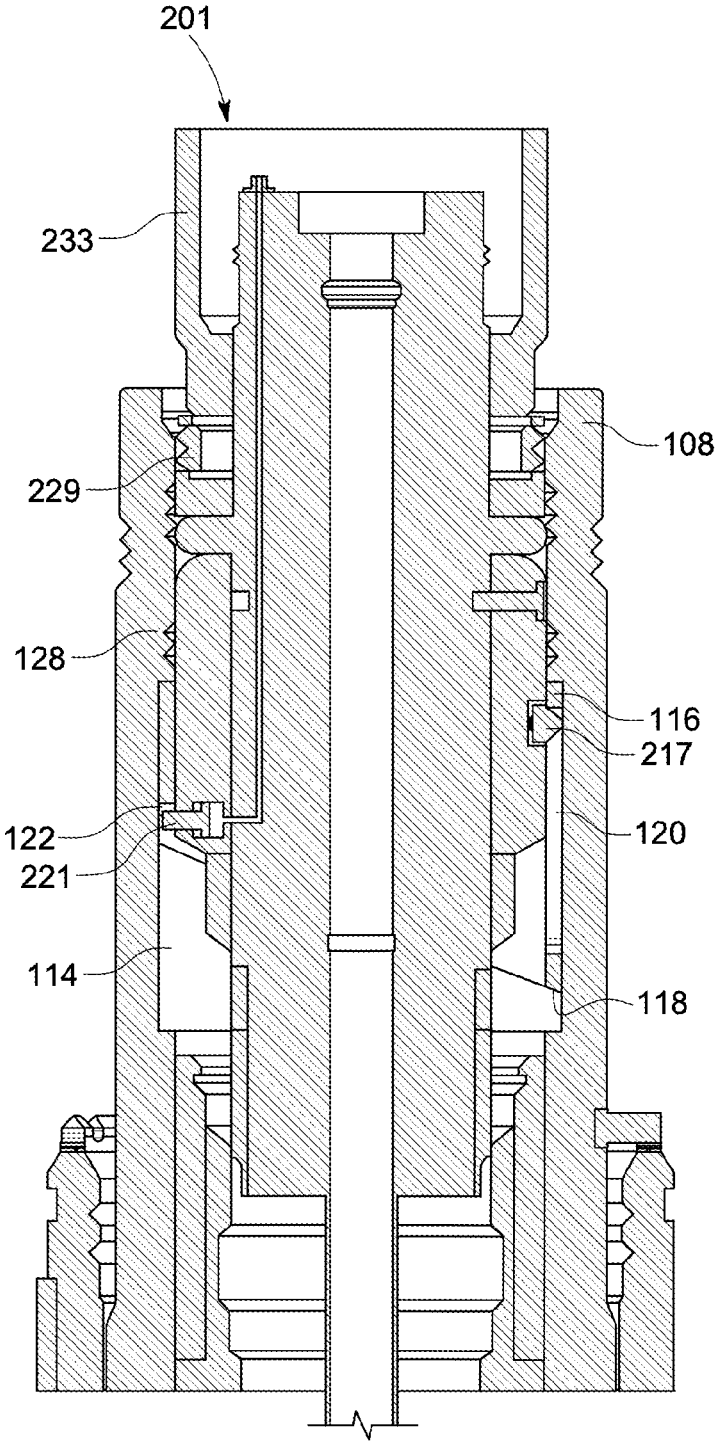
FIG. 6 depicts a section view of a tubing hanger orientation system according to one embodiment where the tubing hanger has been raised and rotated such that the orientation pin is in the capture feature.
Figure 7:
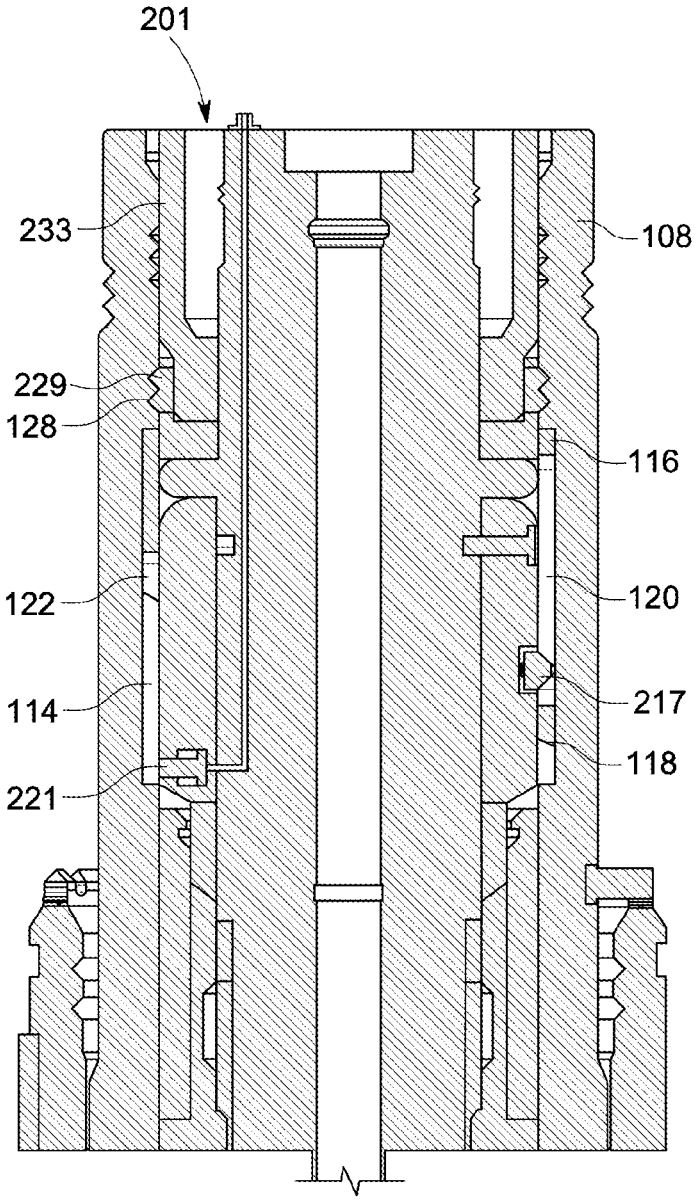
FIG. 7 depicts a section view of a tubing hanger orientation system according to one embodiment where the tubing hanger has been relanded and locked in place in the proper orientation.

FIGS. 5-7 show cross-sections of how the system works to orient the tubing hanger in the wellhead. All cross-section views are taken through the centerline of the components unless otherwise noted.

Figure 1:
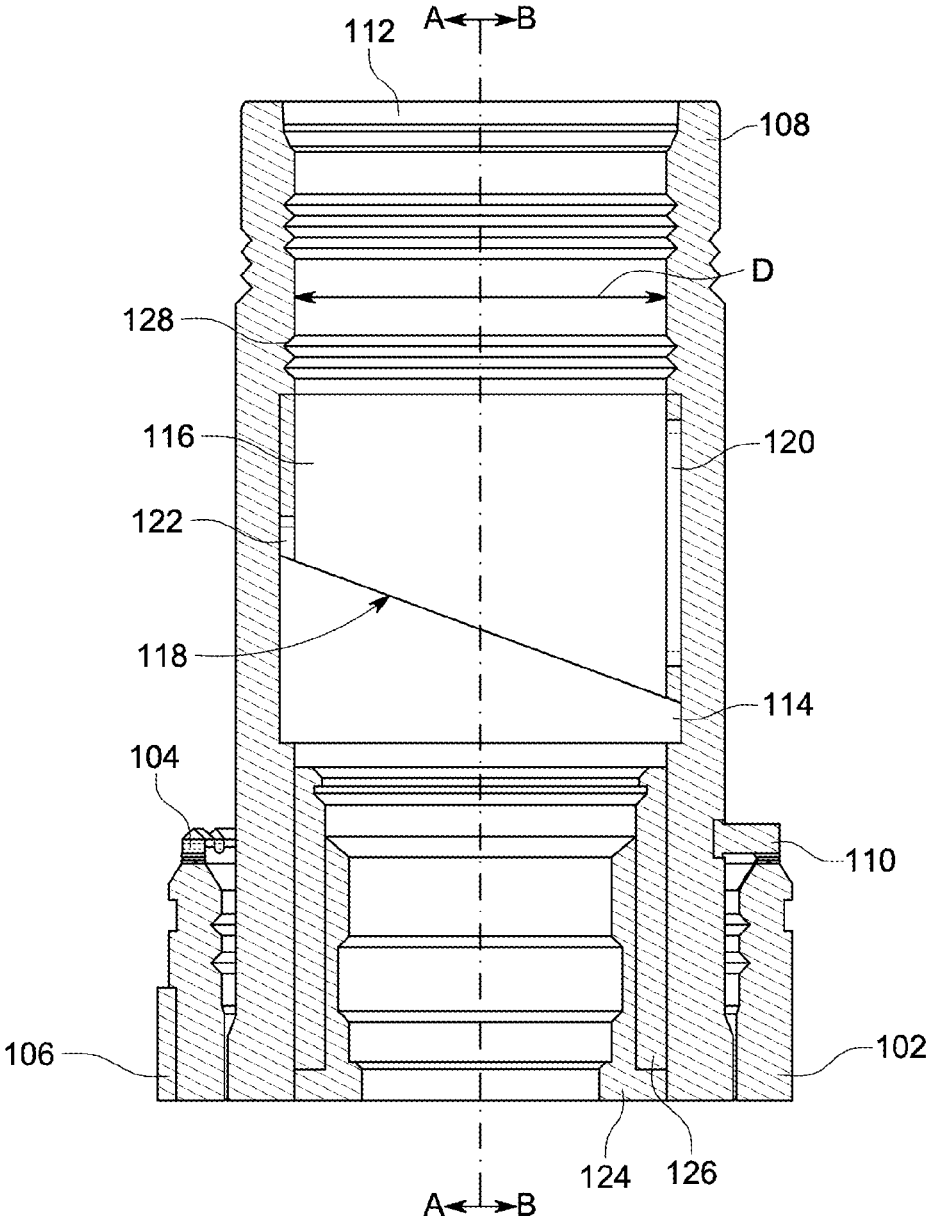
FIG. 1 depicts a section view of a wellhead system according to an embodiment.
Figure 2:
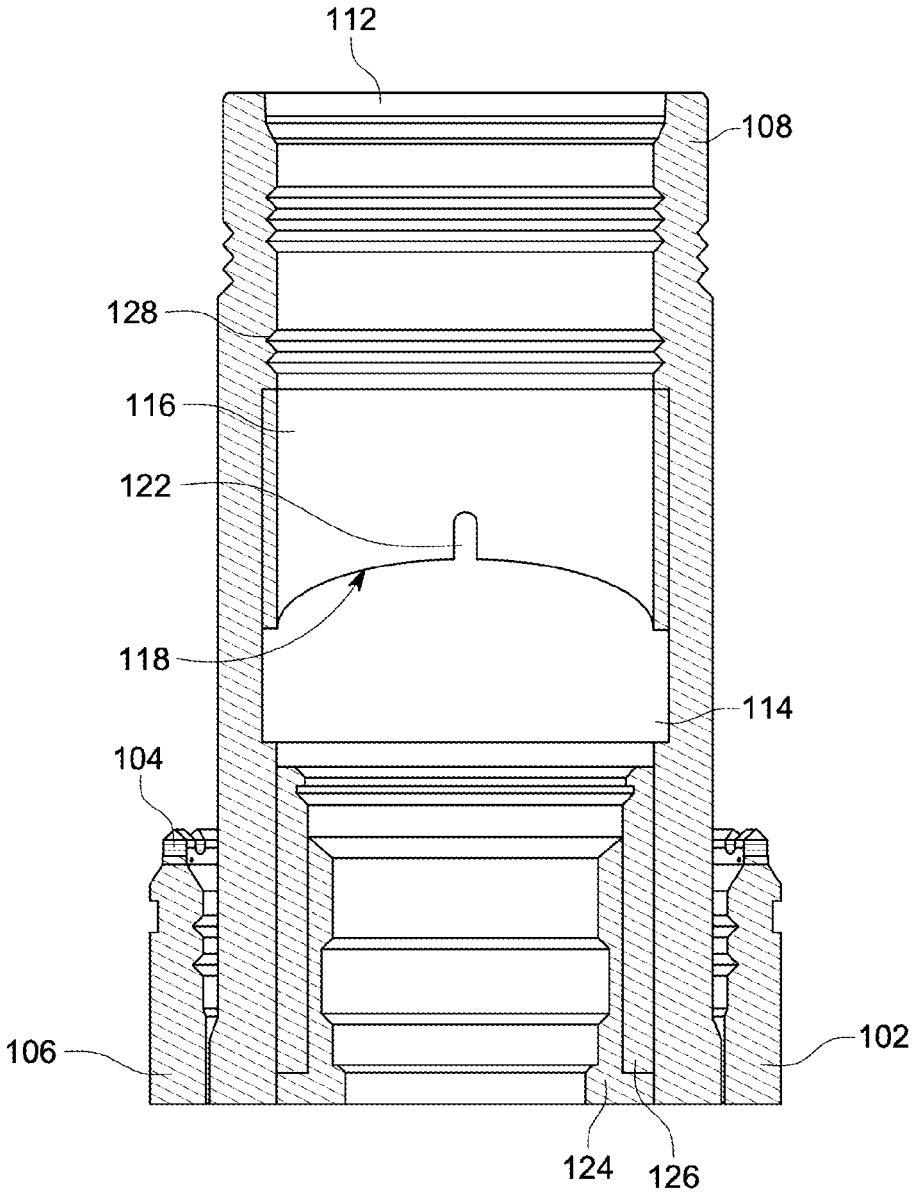
FIG. 2 depicts a section view of the wellhead system of FIG. 1 according to an embodiment where the section view is taken perpendicular to that of FIG. 1.
Figure 3:
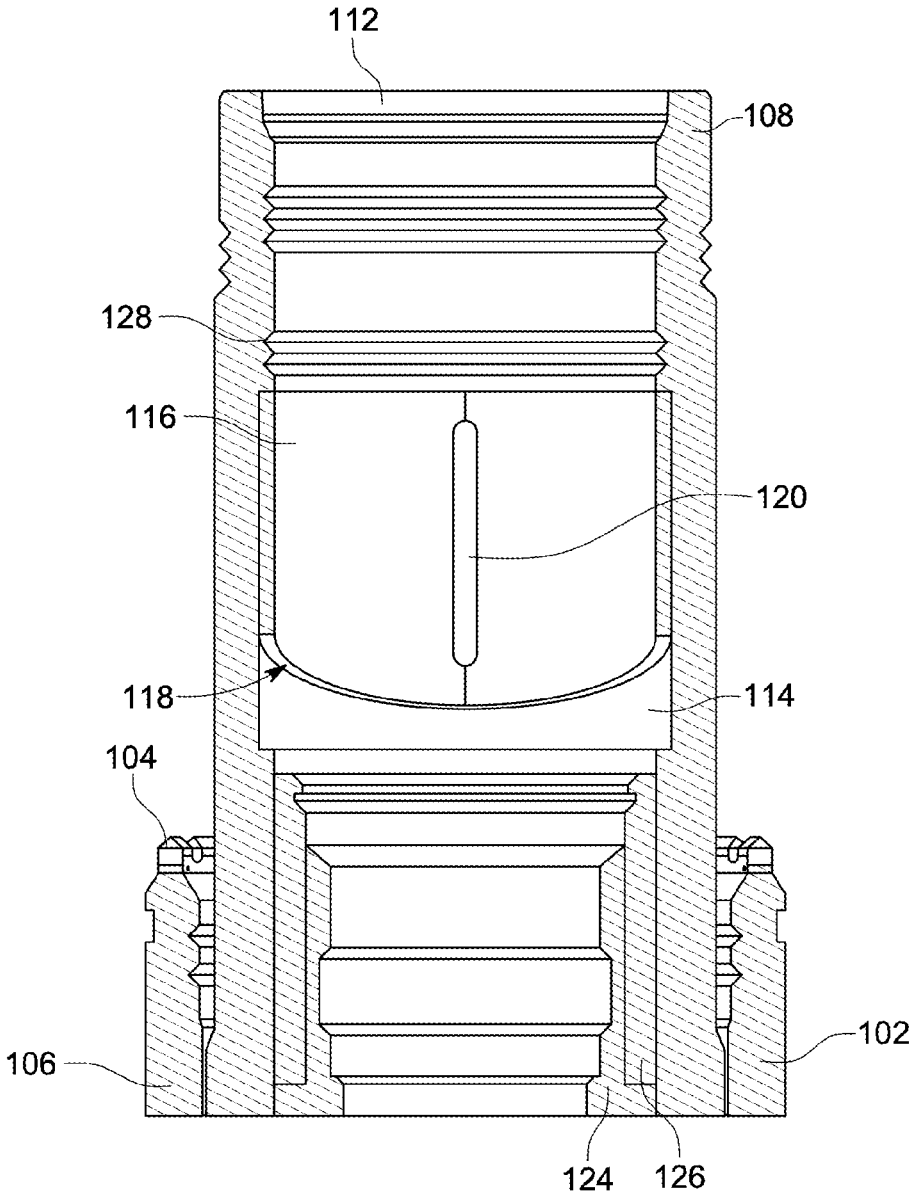
FIG. 3 depicts a section view of the wellhead system of FIG. 1 according to an embodiment where the section view is facing the opposite direction as FIG. 2.

FIGS. 1-3 depict different cross-sections of a wellhead system. FIG. 2 shows a cross-section view perpendicular to that of FIG. 1, in the direction of A as shown in FIG. 1. FIG. 3 shows a cross-section view perpendicular to that of FIG. 1, in the direction of B as shown in FIG. 1, which is opposite the direction of FIG. 2.

In FIGS. 1-3, a low pressure conductor housing 102, typical of subsea wells, comprises a tubular member having a plurality of castellations 104 along the upper circumference. An orientation feature 106, such as a rectangular key, is retained within the low pressure conductor housing 102 and is designed to orient a so-called Christmas tree (not shown) or completion guide base (not shown) with respect to the low pressure conductor housing 102.

High pressure housing 108 comprises a cylindrical member designed to fit within low pressure conductor housing 102. Orientation pin 110 is affixed to the outside diameter of high-pressure housing 108 and is designed to fit within one of the castellations 104. In this manner, orientation pin 110 provides and maintains rotational alignment of high-pressure housing 108 with respect to low pressure conductor housing 102. Orientation pin 110 also provides an external visual indicator of the orientation of vertical slot 120 inside the high-pressure housing 108. The orientation can thus easily be viewed, such as by a remotely operated vehicle (ROV).

Figure 4:
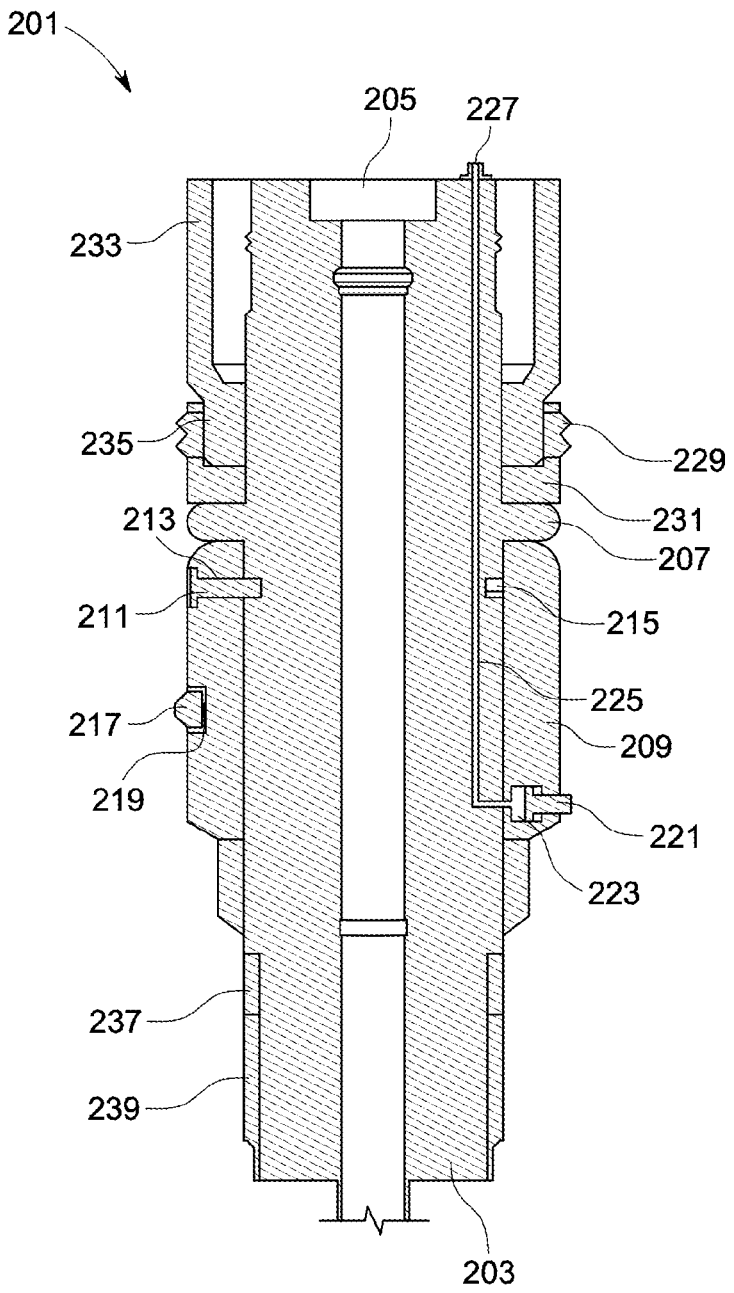
FIG. 4 depicts a section view of a tubing hanger according to one embodiment.

High pressure housing 108 comprises a central bore 112 having a diameter D which is designed to receive a device such as tubing hanger 201 (See FIG. 4). Within central bore 112 is an internal groove 114 having a diameter greater than diameter D. Within internal groove 114 is an orientation helix 116 comprised of a cylindrical tubular member having an outside diameter sized to fit within internal groove 114 and an internal diameter greater or equal to diameter D of central bore 112. Orientation helix 116 may be attached to or integrated with high pressure housing 108. Orientation helix 116 has a lower annular surface 118 in a symmetrical helical shape. On one side of orientation helix 116 is an oval-shaped key slot 120 oriented vertically with respect to the central axis and extends through the outer diameter of orientation helix 116. On the opposite side of orientation helix 116 from key slot 120 is a capture feature 122 in the form of a slot. Unlike key slot 120, capture feature 122 is cut through lower annular surface 118.

Turning now to FIG. 4, tubing hanger 201 is comprised of a tubing hanger body 203 which is a cylindrical member having a central bore 205 that forms a passage through which fluids may be conveyed. Tubing hanger body 203 has a flange 207 against which rests indexable sleeve 209.

Indexable sleeve 209 is comprised of a tubular member having an inner diameter sized to fit on tubing hanger body 203 and an outer diameter smaller than that of diameter D of central bore 112 as well as the inside diameter of orientation helix 116 to allow tubing hanger 201 to fit within the central bore 112 of high pressure housing 108 as shown in FIG. 5, which will be described in greater detail later. Indexable sleeve 209 comprises a locking mechanism which is capable of rotationally locking indexable sleeve 209 to tubing hanger body 203. Specifically, the locking mechanism is in the form of locking pin 211 which passes through a hole 213 through the thickness of indexable sleeve 209 and into one of a plurality of holes 215 formed radially in the tubing hanger body 203. The plurality of holes 215 in the indexable sleeve 209 allow it to be rotationally aligned and secured in a variety of orientations.

Protruding from the outer circumference of indexable sleeve 209 is an outwardly biased key 217. Key 217 is held in a recess of indexable sleeve 209 and is spring loaded by spring 219 between the key and the recess in the tubing hanger body 203. Key 217 has a chamfered upper and lower surface so that when tubing hanger 201 is lowered into central bore 112, the key, which extends beyond diameter D, is pushed into the indexable sleeve recess, allowing the tubing hanger 201 to be freely installed and removed in the high pressure housing 108 without hanging up. Key 217 has a width less than that of the width of key slot 120 such that the key 217 fits into the key slot 120 when they are in axial and rotational alignment.

Opposite of the outwardly biased key 217 is a tubing hanger orientation pin 221. Orientation pin 221 is designed to be extended or retracted radially. When in an extended position, the orientation pin 221 may be extended beyond the outer diameter of the indexable sleeve to interfere with lower annular surface 118. In a retracted position, the orientation pin 221 may be retracted to not interfere with lower annular surface 118 or any other feature of central bore 112. Orientation pin 221 is sized to fit within capture feature 122.

Orientation pin 221 may be extended or retracted by use of hydraulic pressure or may be retracted by a spring. The head of the orientation pin 221 may be sealed against the chamber 223 containing the pin 221 using an O-ring or other seal type. The rear of the chamber 223 is in communication with a hydraulic channel 225 that runs through the indexable sleeve 209 and the tubing hanger body 203 all the way to the top surface of the tubing hanger body to coupler and port 227. Coupler and port 227 acts to securely connect the hydraulic channel 225 to the surface equipment for actuating orientation pin 221.

A locking mechanism on the tubing hanger 201 is capable of selectively locking and unlocking the tubing hanger in the high-pressure housing 108. The locking mechanism comprises a plurality of dogs 229 arranged radially around the outside of tubing hanger body 203 and supported by a dog support ring 231. Dog support ring 231 has a cylindrical shape and comprises a plurality of windows which retain the dogs 229. Actuation sleeve 233 is designed to slide axially up and down to engage or disengage the dogs 229. Actuation sleeve 233 has a tapered lower section 235 that engages with a tapered rear surface of dogs 229 such that lowering the actuation sleeve 233 causes dogs 229 to extend radially outward. Dogs 229 have a V-shaped outer profile that is designed to interface with V-shaped tubing hanger grooves 128 formed in the inside surface of high pressure housing 108.

Below the orientation helix 116 and internal groove 114 of the high pressure housing 108, one or more casing hangers 124 are installed along with packoff seals 126, which provide a seal between the high pressure housing 108 and the casing hanger 124. A tubing hanger seal 237 and a seal retaining ring 239 on the tubing hanger 201 provide a seal between the tubing hanger body 203 and the casing hanger 124.

FIGS. 5-7 show how the tubing hanger orientation system is used to orient the tubing hanger in the wellhead. Referring to FIG. 5, the tubing hanger 201 is lowered down into the central bore of the high pressure housing 108. The tubing hanger is physically stopped in the required axial position by the casing hanger to provide axial location. Orientation pin 221 is extended radially outward into internal groove 114 by hydraulic pressure.

Turning now to FIG. 6, tubing hanger 201 is then lifted upward, causing orientation pin 221 to contact lower annular surface 118 of orientation helix 116. The angle of the helical shape of orientation helix 116 is chosen so that the upward force on tubing hanger 201 causes a lateral force between orientation pin 221 and lower annular surface 118 sufficient to cause rotation of the tubing hanger 201 with respect to the high pressure housing 108. As the tubing hanger 201 is lifted and rotated, the outwardly biased key 217 is pushed inward by orientation helix 116 such that the key may slide along the inside surface of orientation helix 116. Tubing hanger 201 continues to rotate while being lifted upward until orientation pin 221 reaches capture feature 122. In the example shown in FIG. 6, the tubing hanger 201 has rotated approximately 180 degrees from the position shown in FIG. 5. Once orientation pin 221 reaches capture feature 122, the outwardly biased key 217 will be in alignment with key slot 120, causing the key to extend into the key slot and thus prevent rotation of the tubing hanger. The tubing hanger 201 is raised further upward until orientation pin 221 contacts the upper surface of capture feature 122, preventing further upward movement of the tubing hanger and providing indication at the surface that the tubing hanger has correctly orientated within the high pressure housing.

Turning now to FIG. 7, once the tubing hanger 201 is in rotational alignment with the high pressure housing 108, the tubing hanger is then relanded in the wellhead. As the tubing hanger 201 is lowered, outwaradly biased key 217 rides in key slot 120 preventing rotation of the tubing hanger 201. Once the tubing hanger is in the required axial position, the actuation sleeve 233 is lowered, pushing dogs 229 outward and into the tubing hanger grooves 128 to lock the tubing hanger in place. The tubing hanger is now properly oriented and secured in position for connection to other equipment.

The tubing hanger orientation system described herein provides several advantages over current systems and methods. Unlike prior art systems, the tubing hanger orientation system described herein provides two methods of verification that the tubing hanger is properly aligned. Because the vertical distance between the lower position shown in FIG. 5 with the tubing hanger landed and the upper position shown in FIG. 6 is known, operators at the surface can receive confirmation that the tubing hanger is in the desired rotational alignment. Additionally, the force applied in lifting the tubing hanger can be used to provide confirmation of the alignment. The force required to lift the tubing hanger 201 will start off at a base level and then increase when the orientation pin 221 contacts the lower annular surface 118 of the orientation helix 116. When the orientation pin 221 reaches the capture feature 122, the force will return to the base level for a short distance until the orientation pin 221 contacts the top surface of the capture feature 122 of the orientation helix 116 at which point the force will rise sharply. This provides confirmation that the orientation pin has extended as it is the only feature that would cause the tubing hanger to stop.

The downward-facing orientation helix reduces the likelihood of debris settling in the lower annular surface or capture feature, increasing the reliability of the system. The outwardly biased key is retained in the key slot as the tubing hanger is lowered back down, unlike other systems which may allow the tubing hanger to rotate after alignment. Unlike previous methods, the need for a tubing head spool is eliminated, along with the time required to install it. Whereas other systems rely on a device attached to the wellhead, the present invention incorporates the features into the wellhead, so additional equipment and its installation time is not needed.

It is contemplated that such a tubing hanger orientation system could take many forms without departing from the spirit of the invention.

The discussion herein of the present invention is directed to various embodiments of the invention. The term "invention" is not intended to refer to any particular embodiment or otherwise limit the scope of the disclosure. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Herein, the terms "including," "consisting of", and "comprising" are used in an open-ended fashion, and thus should be interpreted to mean "including, but not limited to." Also, the term "connect" or "connected" where used if at all is intended to mean either an indirect or direct connection. Thus, if a first component connects to a second component, that connection may be through a direct connection or through an indirect connection via other components and connections.

The term "or" is used in the inclusive manner. For example, "A or B" could mean A only, B only, or both A and B.

Certain terms are used throughout the description and claims to refer to particular system components and method steps. As one skilled in the art will appreciate, different companies may refer to a component by different names. This document does not intend to distinguish between components that differ in name but not function.

It is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A tubing hanger orientation system, comprising:

a high pressure housing of a wellhead system, comprising:

a central bore having an internal diameter and an orientation helix in the central bore, the orientation helix comprising a lower annular surface having a helical shape; and a tubing hanger, comprising:

an orientation pin capable of being extended radially outward such that when in an extended position the orientation pin interfaces with the orientation helix as the tubing hanger is raised, causing the tubing hanger to rotate.

2. The tubing hanger orientation system of claim 1, wherein the lower annular surface of the orientation helix comprises two helical ramp portions extending in opposite circumferential directions from a common high point to a common low point.

3. The tubing hanger orientation system of claim 1, wherein the orientation helix has a diameter equal or greater than the internal diameter of the central bore of the high pressure housing.

4. The tubing hanger orientation system of claim 1, wherein the tubing hanger further comprises a chamber in the tubing hanger containing the orientation pin and a passage connected to the chamber for applying fluid pressure to extend the orientation pin.

5. The tubing hanger orientation system of claim 1, wherein the high pressure housing further comprises:

a capture feature positioned at an upper most edge of the lower annular surface of the orientation helix, the capture feature comprising a slot sized to accommodate the orientation pin, wherein the slot extends radially outward from the central bore through the orientation helix and opens at the uppermost edge of the lower annular surface such that the orientation pin enters the slot upon reaching an upper end of the helical shape.

6. The tubing hanger orientation system of claim 1, wherein the tubing hanger further comprises:

an indexable sleeve containing an outwardly biased key and the orientation pin, wherein the indexable sleeve can be secured in a plurality of rotational positions relative to a tubing hanger body.

7. The tubing hanger orientation system of claim 6, wherein the indexable sleeve further comprises a radial hole for receiving a locking pin and the tubing hanger body comprises a plurality of radial holes for receiving the locking pin.

8. The tubing hanger orientation system of claim 7, wherein the outwardly biased key has a chamfered upper surface and a chamfered lower surface, allowing the tubing hanger to be inserted or removed from the high pressure housing.

9. The tubing hanger orientation system of claim 1, wherein the high pressure housing further comprises:

a key slot comprising an oval slot extending radially outward through the orientation helix; and wherein the tubing hanger further comprises:

an outwardly biased key sized to fit in the key slot for restricting rotational movement of the tubing hanger relative to the high pressure housing.

10. The tubing hanger orientation system of claim 9, wherein the lower annular surface of the orientation helix comprises two helical ramp portions extending in opposite circumferential directions from a common high point to a common low point.

11. The tubing hanger orientation system of claim 9, wherein the orientation helix has a diameter equal or greater than the internal diameter of the central bore of the high pressure housing.

12. The tubing hanger orientation system of claim 9, wherein the tubing hanger further comprises a chamber in the tubing hanger containing the orientation pin and a passage connected to the chamber for applying fluid pressure to extend the orientation pin.

13. The tubing hanger orientation system of claim 9, wherein the high pressure housing further comprises:

a capture feature positioned at an upper most edge of the lower annular surface of the orientation helix, the capture feature comprising a slot sized to accommodate the orientation pin, wherein the slot extends radially outward from the central bore through the orientation helix and opens at the uppermost edge of the lower annular surface such that the orientation pin enters the slot upon reaching an upper end of the helical shape.

14. The tubing hanger orientation system of claim 9, wherein the tubing hanger further comprises:

an indexable sleeve containing the outwardly biased key and the orientation pin, wherein the indexable sleeve can be secured in a plurality of rotational positions relative to a tubing hanger body.

15. The tubing hanger orientation system of claim 14, wherein the lower annular surface of the orientation helix comprises two helical ramp portions extending in opposite circumferential directions from a common high point to a common low point.

16. The tubing hanger orientation system of claim 14, wherein the orientation helix has a diameter equal or greater than the internal diameter of the central bore of the high pressure housing.

17. The tubing hanger orientation system of claim 14, wherein the tubing hanger further comprises a chamber in the tubing hanger containing the orientation pin and a passage connected to the chamber for applying fluid pressure to extend the orientation pin.

18. The tubing hanger orientation system of claim 14, wherein the high pressure housing further comprises:

a capture feature positioned at an upper most edge of the lower annular surface of the orientation helix, the capture feature comprising a slot sized to accommodate the orientation pin, wherein the slot extends radially outward from the central bore through the orientation helix and opens at the uppermost edge of the lower annular surface such that the orientation pin enters the slot upon reaching an upper end of the helical shape.

19. The tubing hanger orientation system of claim 14, wherein the indexable sleeve further comprises a radial hole for receiving a locking pin and the tubing hanger body comprises a plurality of radial holes for receiving the locking pin.

20. The tubing hanger orientation system of claim 14, wherein the outwardly biased key has a chamfered upper surface and a chamfered lower surface, allowing the tubing hanger to be inserted or removed from the high pressure housing.

* * * * *